US010226084B2

(12) United States Patent
Horner

(10) Patent No.: US 10,226,084 B2
(45) Date of Patent: Mar. 12, 2019

(54) BIKINI BUDDY

(71) Applicant: Michael Dean Horner, Mount Dora, FL (US)

(72) Inventor: Michael Dean Horner, Mount Dora, FL (US)

( * ) Notice: Subject to any disclaimer, the term of this patent is extended or adjusted under 35 U.S.C. 154(b) by 218 days.

(21) Appl. No.: 14/802,522

(22) Filed: Jul. 17, 2015

(65) Prior Publication Data

US 2017/0013892 A1 Jan. 19, 2017

(51) Int. Cl.
*A41D 13/05* (2006.01)
*A41D 7/00* (2006.01)

(52) U.S. Cl.
CPC ..... *A41D 13/0512* (2013.01); *A41D 7/00* (2013.01)

(58) Field of Classification Search
CPC ..... A41F 15/007; A41F 15/00; A41F 15/005; A41F 15/02; A41B 9/16; A41D 13/04
See application file for complete search history.

(56) References Cited

U.S. PATENT DOCUMENTS 2,551,255 A * 5/1951 Engel ..... A41F 15/007 2/336
2,587,101 A * 2/1952 Blalock ..... A41F 15/007 2/460
2,589,755 A * 3/1952 Ward ..... A41F 15/007 2/460
2,633,573 A * 4/1953 Sanders ..... A41F 15/007 2/460
2,637,849 A * 5/1953 Nelson ..... A41F 15/007 2/460
2,654,887 A * 10/1953 Hookstratten ..... A41F 15/007 2/460
2,689,348 A * 9/1954 Crawford ..... A41F 15/007 2/341
2,699,550 A * 1/1955 Freid ..... A41F 15/007 2/107
2,763,004 A * 9/1956 Sanders ..... A41F 15/007 2/460
2,823,383 A * 2/1958 Crawford ..... A41F 15/007 2/460
2,855,602 A * 10/1958 Gerowin ..... A41F 15/007 2/460
3,050,734 A * 8/1962 Dopyera ..... A41F 15/007 2/268
3,154,787 A * 11/1964 Newman ..... A41F 15/007 2/268
3,229,694 A * 1/1966 Koropp ..... A41F 15/007 2/460
3,588,913 A * 6/1971 Ewing ..... A41F 15/007 2/460
4,472,838 A * 9/1984 Pompa ..... A41F 15/007 2/460
4,575,874 A * 3/1986 Johnson ..... A41F 15/007 2/460
4,795,399 A * 1/1989 Davis ..... A41F 15/007 2/267
4,795,400 A * 1/1989 Greenberg ..... A41F 15/007 2/268

(Continued)

*Primary Examiner* — Sally Haden

(57) ABSTRACT

The device is an invention that attaches to the strings of the top to a bikini bathing suit. It provides cushion support to the neck area, and prevents the strings of the top to the bikini bathing suit from painful gouging into the skin due to the weight of the breasts.

1 Claim, 1 Drawing Sheet

(56) References Cited

U.S. PATENT DOCUMENTS

| | | | | | |
|---|---|---|---|---|---|
| 4,945,576 | A * | 8/1990 | Melton | A41F 15/007 | 2/460 |
| 5,558,556 | A * | 9/1996 | Froehlich | A41F 15/007 | 2/267 |
| 5,626,507 | A * | 5/1997 | Gillen | A41C 3/105 | 2/268 |
| 5,691,028 | A * | 11/1997 | Curtis | A41F 15/007 | 2/268 |
| 5,913,413 | A * | 6/1999 | Huyck | A41F 15/007 | 2/268 |
| 2003/0000636 | A1* | 1/2003 | Falla | A41F 15/007 | 156/250 |
| 2003/0186619 | A1* | 10/2003 | Falla | A41F 15/007 | 450/86 |
| 2003/0204897 | A1* | 11/2003 | Cutler | A41F 15/007 | 2/267 |
| 2004/0134602 | A1* | 7/2004 | Falla | A41F 15/007 | 156/250 |
| 2005/0098258 | A1* | 5/2005 | Batcha | A41C 3/00 | 156/250 |
| 2012/0324631 | A1* | 12/2012 | Peper | A41F 15/02 | 2/244 |
| 2013/0253575 | A1* | 9/2013 | Baeza | A61H 39/04 | 606/204 |
| 2017/0035131 | A1* | 2/2017 | Hayman | A41F 15/007 | |

* cited by examiner

BIKINI BUDDY

The device attaches to a bikini bathing suit to provide cushion comfort to the neck area. The strings of the top to the bikini are fished into the endcaps through the body of the device with the fishing tool, then exited out the reinforced center hole. Then the user ties their normal knot with the strings to hold up the top to the bikini.

DETAILED DESCRIPTION OF THE DIAGRAMS AND DRAWINGS

Figure 1:
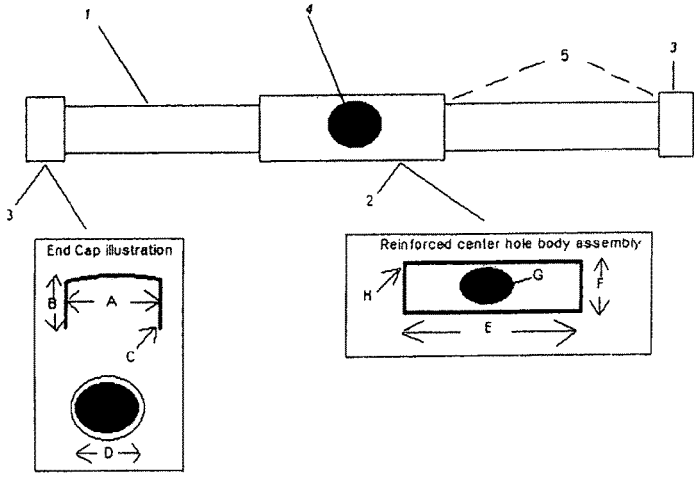

FIG. 1 element 1 Main Body. EPDM (Ethylene Propylene Diene Monomer) round tubing 5½" in length. Outer Diameter ⅜" inches, wall thickness 1/16" inches.

FIG. 1 element 2 Reinforced center hole body assembly. Made of EPDM round tubing. Slides over main body in center portion, and is adhered into place. In the reinforced center hole body assembly illustration element 2 (E) refers to the length of the center body assembly 1.500". Element 2 (F) refers to the inside diameter 0.3750". Element 2(G) refers to the diameter of the outlet hole 0.3125". Element 2 (H) refers to the wall thickness 0.55"

FIG. 1 element 3 EPDM or vinal end caps. Slides onto main body, and is adhered into place. In the end cap illustration element 3 (A) refers to inside diameter of cap 0.3750", element 3 (B) refers to the length of the end cap 0.500" element 3 (C) refers to the wall thickness of the end cap 0.038" element 3 (D) refers to the diameter of the inlet hole in the end of the end cap 0.2500"

FIG. 1 element 4 Reinforced center hole were bikini strings exit, and are tied.

FIG. 1 element 5 adhesive adheres end caps, and center body assembly to the device.

Figure 2:
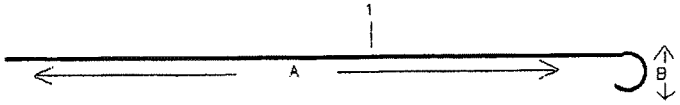

FIG. 2 element 1 Fishing tool—used for fishing end of bikini strings through the body of the device. Tool material metal or plastic. Element 1(A) refers to the length of the tool 6". The tool has a 180 degree turn (hook) at the end. Element 1(B) refers to the diameter of the hook 0.3500".

Figure 3:
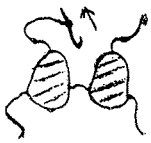

FIG. 3 Insert long part of shaft of the fishing tool through the middle of the loop at the end of the bikini string.

Figure 4:
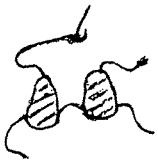

FIG. 4 Then push down strings to hook part of the tool.

Figure 5:
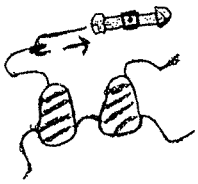

FIG. 5 Insert shaft of the tool in end cap pushing through the body of the device then exiting out the reinforced center hole body assembly.

Figure 6:
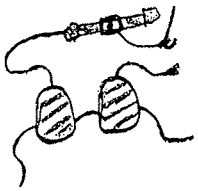

FIG. 6 Fish the strings all the way through the device.

Repeat the steps in order to fish the second string through the other side of the device.

Pull on both sides of bikini strings until the device is snug on back of neck.

Figure 7:
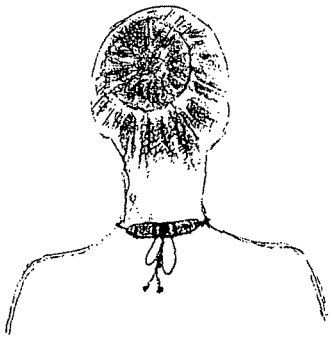

FIG. 7 Tie knot to top of bikini as normally would. The grasping cushing effect from the device will hold the knot into place as you tie the strings for ease of use. The illustration shows the device tied into place.

The invention claimed is:

1. A device designed to receive a string of a bikini bathing suit to cushion a neck area of a wearer, the device comprising:

a tube for receiving the string of the bikini bathing suit;
- the tube having a tube length of about 5.5 inches, the tube length defined between opposite first and second ends;
- the tube having a hollow interior, the hollow interior having a first inlet hole at the first end and a second inlet hole at the second end;
- the tube having an outer diameter of about 0.375 inches;
- the tube having a tube outlet hole cut through a sidewall of the tube at a center of the tube length, the tube outlet hole in communication with the hollow interior;
- the tube being made of ethylene polypropylene diene monomer;

a tubular collar for reinforcing the tube outlet hole;
- the tubular collar having a collar length that is less than the tube length;
- the tubular collar having a collar outlet hole, the collar outlet hole having a same diameter as the tube outlet hole, the collar outlet hole being aligned with and in communication with the tube outlet hole;
- the tubular collar having a collar inside diameter of about 0.375 inches, the collar inside diameter receiving and adhered to an outer surface of the tube;

a first endcap for reinforcing the first inlet hole and a second endcap for reinforcing the second inlet hole;
- each of the first and second endcaps having an endcap length that is less than the tube length;
- each of the first and second endcaps having an endcap inside diameter of about 0.375 inches, the endcap inside diameter of the first endcap receiving and adhered to the outer surface of the tube at the first end, the endcap inside diameter of the second endcap receiving and adhered to the outer surface of the tube at the second end;

in use, the wearer threads the string into one of the first or second inlet holes and out of the tube and collar outlet holes.

* * * * *